US005174916A

United States Patent [19]

Osgood

[11] Patent Number: 5,174,916

[45] Date of Patent: Dec. 29, 1992

[54] LUBRICANT ADDITIVE COMPOSITION CONTAINING NONIONIC FLUOROCHEMICAL POLYMER AND METHOD OF USING SAME

[76] Inventor: Gordon Osgood, 61407 Spring Cir. Trail, Romeo, Mich. 48065

[21] Appl. No.: 597,432

[22] Filed: Oct. 15, 1990

Related U.S. Application Data

[63] Continuation-in-part of Ser. No. 429,162, Oct. 30, 1989, abandoned, and a continuation of Ser. No. 229,975, Aug. 9, 1988, abandoned, which is a continuation-in-part of Ser. No. 128,100, Mar. 2, 1987, abandoned.

[51] Int. Cl.[5] ..... C01M 141/04

[52] U.S. Cl. ..... 252/54; 252/50; 252/58; 252/52 A

[58] Field of Search ..... 252/54, 58, 50, 52 A

[56] References Cited

U.S. PATENT DOCUMENTS

| | | | |
|---|---|---|---|
| 3,367,868 | 2/1968 | Skehan | 252/34.7 |
| 3,505,229 | 4/1970 | Skehan | 252/54 |
| 3,980,715 | 9/1976 | Szur | 252/54 |
| 4,111,821 | 9/1978 | Lazarus et al. | 252/49.9 |
| 4,127,491 | 11/1978 | Reick | 252/16 |
| 4,177,153 | 12/1979 | Lowe | 252/50 |
| 4,224,173 | 9/1980 | Reick | 252/58 |
| 4,284,518 | 8/1981 | Reick | 252/58 |
| 4,284,519 | 8/1981 | Reick | 252/58 |
| 4,497,720 | 2/1985 | Moriga et al. | 252/54 |
| 4,737,301 | 4/1988 | Bloch et al. | 252/45 |

OTHER PUBLICATIONS

IBM Technical Disclosure Bulletin, Jun. 1972, Water Soluble Grease, H. G. Peters et al.

*Primary Examiner*—Prince E. Willis
*Assistant Examiner*—Jerry D. Johnson

[57] ABSTRACT

A substantially particulate-free homogeneous lubricant additive includes a first nonionic fluorochemical surfactant selected from the group consisting of fluoroaliphatic oxyethylene adducts and fluoroaliphatic oxypropylene adducts, and a second oil solubilizing nonionic surfactant and a transport or carrier medium ranging from light oil to grease. The additive also utilizes an antioxidant, a petroleum distillate solvent and a bactericide.

7 Claims, No Drawings

LUBRICANT ADDITIVE COMPOSITION CONTAINING NONIONIC FLUOROCHEMICAL POLYMER AND METHOD OF USING SAME

CROSS-REFERENCE TO RELATED APPLICATION

This application is a continuation-in-part of U.S. Ser. No. 429,162 filed Oct. 30, 1989 now abandoned which is a continuation of U.S. Ser. No. 229,975 filed Aug. 9, 1988 now abandoned. Ser. No. 229,975 was a continuation-in-part of Ser. No. 128,100, filed on Mar. 2, 1987 now abandoned. The disclosure of U.S. patent application Ser. No. 128,100 is hereby incorporated by reference, along with the disclosures of each of the above-identified succeeding applications.

BACKGROUND OF THE INVENTION

1. Field of the Invention

This invention relates to a novel lubricant additive which utilizes a nonionic fluorochemical polymer surfactant as an important ingredient thereof, a modified lubricant composition using the additive hereof, and a method of using the additive hereof.

2. Background of the Prior Art

The prior art discloses various engine lubricant additive compositions containing polytetrafluoroethylene (PTFE) particles and a nonionic, anionic or cationic fluorochemical surfactant for stabilizing the dispersion of the particles in the lubricant. The PTFE particles perform the function of lubrication, being carried to the metal surface of the engine and adhering to it. An example of such a lubricant additive is found in U.S. Pat. No. 4,244,173 which teaches a lubricant additive containing PTFE particles and a nonionic fluorochemical surfactant sold under the trade name ZONYL®, a modified polyethylene glycol-type surfactant.

Other patents disclose lubricant additives of varying compositions. U.S. Pat. Nos. 4,159,252 and 4,127,491 each disclose lubricants including a halogenated organic lubricant or halocarbon oil, among other ingredients. U.S. Pat. Nos. 2,582,282 and 2,603,627 disclose other halogenated polymers or condensation products useful as lubricants or oil additives. U.S. Pat. No. 2,510,540 notes that polymers of propylene oxide have been suggested as lubricants some time ago, but were deemed unsatisfactory because of their low viscosity. The patent discloses a mineral oil additive comprising a mixture of homopolymeric ethers of 1,2-epoxy linear hydrocarbons.

U.S. Pat. No. 3,980,715 is directed to particular nonionic fluorochemical surfactants, particularly those resulting as a reaction of 6-hydroxyhexyl perfluoroisopropyl ether with ethylene oxide or of hexafluorobutenol with propylene oxide and ethylene oxide.

The prior art teaches away from the use of propylene oxide polymers as lubricants, for the reason that their low viscosity indices make such polymers unsuitable for use as lubricants. This is stated in U.S. Pat. No. 2,510,540.

It is desirable to provide a substantially particulate-free homogeneous lubricant additive, which provides effective lubrication in the absence of solid particulates in the composition.

SUMMARY OF THE INVENTION

In accordance herewith, there is provided a substantially particulate-free homogeneous engine lubricant additive having excellent filming and lubricating capability, as well as cleaning capability.

The lubricant additive hereof, generally, comprises:

between about 0.33 percent and about 0.46 percent by weight of a nonionic fluorochemical surfactant which is the product of reaction between a $C_1$ to $C_4$ fluoroaliphatic compound and an alkylene oxide selected from the group consisting of ethylene oxide, propylene oxide and mixtures thereof;

between about 0.35 and about 0.40 percent by weight of an alkyl aryl alkoxylate nonionic surfactant; and a hydrocarbon-based transport medium which may range in viscosity from a fine oil with a viscosity of about 2 cS at 40° C. to a heavy grease with a viscosity of about 1100 cS at 40° C.

Suitable carriers may include, but are not limited to, spindle oil, mineral oil, blended oil and grease. The lubricant additive may also include a petroleum distillate solvent, an amine antioxidant compound, and a bactericide.

The present invention provides a lubricant additive having excellent filming, lubricating and cleaning capability and is excellent for use on metal, plastic, teflon, rubber and neoprene surfaces as well as other materials not here mentioned.

The type and amount of the above-listed components can be varied so that the lubricant additive exhibits the effectiveness and characteristics desired.

The composition of the present invention may also be added to diesel fuel or to gasoline to enhance lubrication of valve train components by application through the fuel system.

For a more complete understanding of the present invention, reference is made to the following detailed description and accompanying examples.

DETAILED DESCRIPTION OF THE PREFERRED EMBODIMENT

The homogeneous lubricant additive composition of the present invention exhibits excellent lubricating and cleaning capability, without requiring the addition of a solid particulate such as graphite or polytetrafluoroethylene. The composition hereof is, therefore, substantially particulate-free. It has been found that the composition hereof provides enhanced lubrication, resulting in a substantial reduction in friction and consequently reduction in wear and reduced operating temperatures, of engines or machinery employing the lubricant composition or lubricant additive hereof.

A lubricant composition of the present invention, as noted, generally comprises:

(1) a first nonionic surfactant selected from the group consisting of:

(a) fluoroaliphatic oxyethylene adducts and (b) fluoroaliphatic oxypropylene adducts; and (c) mixtures thereof;

(2) a second nonionic surfactant having oil solubilizing capabilities; and (3) a transport medium which ranges in viscosity from about 2 cS at 40° C. to about 1100 cS at 40° C., the range varying from a light spindle oil to a grease composition. The additive may also include a middle weight petroleum distillate solvent; an amine antioxidant compound; and a bactericide.

The lubricant composition use solution hereof generally comprises, based on the total weight, from about 0.33 percent to about 0.46 percent by weight of the first surfactant comprising a nonionic fluorochemical surfactant; a second nonionic surfactant present in an amount between about 0.35 percent to about 0.40 percent by weight; a transport medium present in an amount between about 94 percent and 99 percent by weight.

The composition may also contain an amine antioxidant compound present in an amount between about 0.25 percent to about 0.35 percent by weight; a bactericide present in an amount between from about 0.15 percent to about 0.20 percent by weight and a middle weight petroleum distillate present in an amount between 0.70 percent to about 0.80 percent by weight.

The nonionic fluorochemical polymer, used herein is an alkylene oxide adduct of a fluoroaliphatic compound. Useful alkylene oxides include ethylene oxide, propylene oxide or mixtures thereof. Useful fluoroaliphatic compounds are $C_1$ to $C_4$ fluoroaliphatic compounds with which the alkylene oxide is reacted. Prefereably, the fluoroaliphatic compound employed herein is a propylene oxide adduct of hexafluoropropylene, sold commercially under the trade name FC-176 Fluorad ® and is available from 3M Corp. The surfactant has extraordinary lubricating capability without requiring the use of solid particulates such as PTFE or graphite. Without wishing to be bound by any theory, it is believed that the inclusion of the nonionic fluorochemical surfactant causes the lubricant to strongly adhere to surfaces. The improved surface adhering capability of the lubricant results in decreased friction and decreased corrosion within the system. The surfactant also acts to disperse contaminant particles present in the lubricant until they are trapped by a filter.

The second nonionic surfactant acts as an oil solubilizing agent. The oil solubilizing surfactant aids in the transport and effectiveness of other components of the composition. The second nonionic surfactant is generally present in an alkyl aryl alkoxylate, such as octyl, nonyl, decyl, dodecyl, or phenyl ethoxylate. The preferred nonionic surfactant for this purpose is nonyl phenoxy polyethoxy ethanol and is sold under the trade name Triton-N-60 and is available from Rohm and Haas Company.

The carrier or transport medium employed in the composition hereof varies according to the composition of the lubricant to be used. The transport medium may range from a very light spindle oil having a viscosity of about 2 cS at 40° C. to a heavy grease composition having a viscosity of about 1100 cS at 40° C. The carrier medium may comprise a very fine spindle oil for an additive to be used with alcohols, gasoline or kerosene. A blended base stock oil such as Pennzoil ® or Quaker State ® 5W-30, 10W-30, 10W-40 or 20W-50 or other commonly used grade may be utilized when the additive is for use in engine oil. 90 weight oil may be used for differentials or transmissions. Grease may be utilized when the additive is for use in axle grease. The present invention is adapted to be utilized any one of the carrier media within this range.

Where used, the middle weight petroleum distillate acts as a solvent in the lubricant additive. The distillate solvent is used to disperse or eliminate sludge from the system. The petroleum distillate removes build-up from surfaces which results in less friction between the surfaces. The distillate contains naptha compounds and has a molecular weight range between 350 and 550 amu. The distillate is available under the trade name FS-22 available from the Betz Industrial Group.

The antioxidant compound, present in the form of an amine, where employed, is used to inhibit corrosion. The amine may be an alicyclic or aliphatic amine as are readily oxidized and seve as highly effective antioxidants. Examples of such amines are cyclohexylamine, N,N dimethylcyclohexylamine, decyl dimethyl amine, N,N-dimethyl octyl amine, octyl amine, ethyl hexyl amine $C_6$ to $C_{10}$ and 2-ethyl-1-Hexylamine. The preferred antioxidant composition is N,N-dimethylcyclcohexylamine. With the use of the antioxidant, corrosion is substantially reduced or virtually eliminated, and friction is minimized. The friction reduction in turn results in reduced operating temperatures and more efficient running of an engine or motor.

A bactericide is preferably employed in the lubricant composition hereof to kill any bacteria present within the lubrication system and prevent new growth of bacteria within the system. Elimination of bacterial growth is important as it reduces friction due to the rubbing of bacteria contaminated surfaces, and also reduces carbon buildup in the lubrication system caused by the decomposition of bacterial remains within the system. Although any conventional bactericide may be used, the preferred bactericide is manufactured under the trade name BIOBOR JF ®, manufactured by United States Borax Corporation. This formulation generally comprises as its active ingredients a mixture of 2,2'-(1-methyltrimethylenedioxy)bis(4-methyl-1,3,2-dioxaborinane) and 2,2'-oxybis(4,4,6-trimethyl-1,3,2-dioxaborinane), because of its compatibility and utility with any of the transport media.

A concentrated additive may be premixed in which the components exclusive of the carrier, make up from 8–40% of the total with the carrier making up the balance. In the actual use solution, the composition exclusive of the carrier should be from 0.5–5% by weight of the total composition, with the carrier making up the balance.

For enhanced lubrication, the lubricant additive is added to an engine lubricant, such as engine oil, transmission fluid, or axle grease, and circulated therethrough to form a homogeneous composition employed with the lubricant as it is circulated through its particular system.

When the composition hereof is prepared for use with a grease carrier medium, a molybdenum disulfide powder having the formula $M_oS_2$ is added for enhanced lubrication. The powder is sold under the trade name Molykote ®-Z Powder and is available from Dow Corning Corp. The Molybdenum disulfide additive is present in an amount between about 0.20 percent and about 1.00 percent of the total weight of the lubricant use composition.

As the lubricant containing the additive contacts surfaces throughout the particular system or parts of the particular system, the additive acts to clean surfaces by the removal of corrosion, sludge and bacteria from the system. The amne substantially prevents further corrosion from forming on the surfaces. The bactericide reduces the number of bacteria present as well as preventing further growth of the bacteria. The surfactants in the carrier medium enhance lubricating action to the cleaned surfaces and retention of oil on those surfaces. The enhanced lubrication provides a substantial reduction in friction and consequent decrease in wear and in system operating temperatures. The system is therefore able to run more efficiently, resulting in enhanced fuel savings.

For a more complete understanding of the present invention, reference is made to the following examples. The examples are to be construed as illustrative and not limitative of the present invention.

EXAMPLE I

The following example describe a proposed formulation of a use solution of an oil utilizing the lubricant additive of the present invention.

| OIL ADDITIVE | | |
|---|---|---|
| Ingredient | Amounts Present in Percent By Weight | Mass (g) |
| Fluoroaliphatic Surfactant (FC-176 Fluorad ®) | .39 | 66.3 |
| Nonylphenoxypolyathoxyethanol (Triton-N-60) | .36 | 61.2 |
| Middle Weight Petroleum Distillate (FS-22) | .80 | 136.0 |
| Bactericide (Biobor ®) | .18 | 30.6 |
| Antioxidant-Amine | .30 | 51.0 |
| Transport Medium (Dearlube ®) | 97.97 | 16,654.9 |

The composition is prepared by forming a first mixture by admixing the first three ingredients in a suitable vessel with stirring at temperatures between about 70° F. and about 80° F.

A second mixture is formed by admixing the last three ingredients, with stirring in a suitable mixing vessel at the above stated temperatures.

The first mixture is added to the second mixture at the above-stated temperatures to form the lubricant composition.

EXAMPLE II

The following example describes a proposed formulation of a use solution of a transmission fluid utilizing the lubricant additive of the present invention.

| AUTOMATIC TRANSMISSION FLUID ADDITIVE | | |
|---|---|---|
| Ingredient | Amounts Present in Percent By Weight | Mass (%) |
| Middle Weight Petroleum Distillate (FS-22) | .80 | 136 |
| Fluoroaliphatic Oxyalkylene Sold under the trade name (FC-176 Fluorad ®) | .40 | 68 |
| Nonylphenoxypolyethoxy Ethanol (Triton ® N-60) | .37 | 62.9 |
| Dimethylcyclohexylamine | .30 | 51 |
| Bactericide | .18 | 30.6 |
| Transport Medium (Canfield ® ATF) | 97.95 | 16,651.5 |

The composition is prepared by forming a first mixture by admixing the first three ingredients in a suitable vessel with stirring at temperatures between about 70° F. and about 80° F.

A second mixture is formed by admixing the last three ingredients, with stirring in a suitable mixing vessel at the above-stated temperatures.

The first mixture is added to the second mixture at the above-stated temperatures to form the lubricant composition.

EXAMPLE III

The following example describes a proposed formulation of a use solution of an axle grease utilizing the lubricant additive of the present invention.

| GREASE ADDITIVE | | |
|---|---|---|
| Ingredient | Amounts Present in Percent By Weight | Mass (g) |
| Middle Weight Petroleum Distillate (FS-22) | .80 | 136 |
| Fluoroaliphatic Surfactant (Fluorad FC-176) | .39 | 66.3 |
| Nonylphenoxypolyethy-oxyethanol (Triton N-60) | .36 | 61.2 |
| Bactericide (Biobor ®) | .18 | 30.6 |
| Dimethylcyclohexylamine (MDS-2) | .30 | 51.0 |
| Molybdenum Disulfide (Molykote ®-Z Powder) | .66 | 112.2 |
| Transport Medium (axle grease) | 97.31 | 16,542.7 |

The composition is prepared by forming a first mixture by admixing the first three ingredients in a suitable mixing vessel with stirring at temperatures between about 70° F. and about 80° F.

A second mixture is formed by admixing the last four ingredients with stirring in a suitable vessel at the above-stated temperatures.

The first mixture added to the second mixture at the above-stated temperatures to form the lubricant composition.

EXAMPLE IV

| Component | % | PPM |
|---|---|---|
| PROPOSED GASOLINE ADDITIVE FOR USE WITH A TANK FUEL IN A RATIO OF ABOUT 8 OZ. ADDITIVE :25 GAL FUEL | | |
| Ethanol | 96.68 | 966,756.3 |
| Ethyl Acetate | 0.997 | 9,966.6 |
| Methyl-Isobutyl Ketone | 0.997 | 9.966.6 |
| Heptane | 0.997 | 9,966.6 |
| $BF_3 + H_3PO_4$ | 0.01476 | 147.6 |
| $BF_3 + (HOA_c)_2$ | 0.00270 | 27.0 |
| $BF_3 + Et_2O$ | 0.00450 | 45.0 |
| Dimethylcyclohexylamine | 0.01336 | 133.6 |
| C-176 Fluorad | 0.04300 | 430.0 |
| M60 | 0.00812 | 81.2 |
| Methylethyl Ketone | 0.10738 | 1,073.8 |
| MEK Peroxide | 0.07733 | 773.3 |
| 6% Cobalt | 0.06326 | 632.6 |
| PROPOSED DIESEL ADDITIVE FOR USE 8 OZ. ADDITIVE TO APPROXIMATELY 25 GAL FUEL | | |
| Kerosene | 99.57628 | 995,762.8 |
| $BF_3 + H_3PO_4$ | 0.01445 | 144.5 |
| $BF_3 + (HOA_c)_2$ | 0.00264 | 26.4 |
| $BF_3 + Et_2O$ | 0.00441 | 44.1 |
| Dimetylcyclohexylamine | 0.01308 | 130.8 |
| C-176 Fluorad | 0.04211 | 421.1 |
| NP-5 | 0.00795 | 79.5 |
| Methylethyl Ketone | 0.10517 | 1,051.7 |
| MEK Peroxide | 0.07573 | 757.3 |
| 6% Cobalt | 0.06196 | 619.6 |
| Biobor | 0.01619 | 161.9 |
| Fuel Solvent-22 (Betz Products) | 0.02793 | 279.3 |
| Methyl-Isobutyl Ketone | 0.05209 | 520.9 |

Having, thus, described the invention, what is claimed is:

1. A substantially particulate-free homogeneous liquid lubricant comprising:

between about 0.33 percent and about 0.46 percent by weight of a first surfactant comprising: a nonionic fluorochemical surfactant selected from the group consisting of fluoroaliphatic oxyethylene adducts and fluoroaliphatic oxypropylene adducts;

between about 0.35 and about 0.40 parts by weight of a second surfactant comprising a nonionic surfactant having oil solubilizing capabilities; and between about 94 percent and about 99.4 percent by weight of a hydrocarbon-based transport medium.

2. The lubricant of claim 1 further comprising a middle weight petroleum distillate present in an amount between about 0.70 percent and about 0.80 percent by weight.

3. The lubricant of claim 1 further comprising an amine antioxidant present in an amount between about 0.25 percent and about 0.35 percent by weight.

4. The lubricant composition of claim 1 further comprising a bactericide present in an amount between 0.15 percent and about 0.20 percent by weight.

5. The lubricant composition of claim 1 wherein the alkyl aryl alkoxylate surfactant comprises nonylphenoxypolyethoxyethanol.

6. The lubricant composition of claim 1 wherein the hydrocarbon-based transport medium comprises a blended base stock motor oil.

7. The lubricant composition of claim 1 wherein the hydrocarbon-based transport medium comprises a transmission fluid.

* * * * *